US008769750B2

(12) United States Patent
Hallander et al.

(10) Patent No.: US 8,769,750 B2
(45) Date of Patent: Jul. 8, 2014

(54) BOOT MACHINE-DEVICE

(75) Inventors: Fredrik Hallander, Älvsjö (SE); Leif Carlsson, Saltsjöbaden (SE); Johan Monsen, Are (SE)

(73) Assignee: Solemate AB, Saltsjobaden (SE)

( * ) Notice: Subject to any disclaimer, the term of this patent is extended or adjusted under 35 U.S.C. 154(b) by 758 days.

(21) Appl. No.: 12/833,156

(22) Filed: Jul. 9, 2010

(65) Prior Publication Data

US 2011/0035887 A1 Feb. 17, 2011

Related U.S. Application Data

(60) Provisional application No. 61/226,377, filed on Jul. 17, 2009.

(51) Int. Cl.
*A43D 95/00* (2006.01)
*A43D 8/00* (2006.01)

(52) U.S. Cl.
USPC ..... 12/17 R; 12/33; 12/123; 269/60; 269/71

(58) Field of Classification Search
USPC ..... 12/70, 74.5, 17 R, 33, 33.6, 120.5, 123; 269/55, 60, 71, 291
See application file for complete search history.

(56) References Cited

U.S. PATENT DOCUMENTS

| | | | | | |
|---|---|---|---|---|---|
| 3,107,376 | A * | 10/1963 | Reid et al. | ..... | 12/1 R |
| 3,400,561 | A * | 9/1968 | Bechtold | ..... | 69/6.5 |
| 3,586,075 | A * | 6/1971 | Larsen | ..... | 83/471.3 |
| 3,603,120 | A * | 9/1971 | Schilke | ..... | 69/6.5 |
| 5,207,097 | A * | 5/1993 | Gutman | ..... | 73/162 |
| 6,948,894 | B2 * | 9/2005 | Taga et al. | ..... | 409/235 |

* cited by examiner

*Primary Examiner* — Khoa Huynh
*Assistant Examiner* — Sharon M Prange
(74) *Attorney, Agent, or Firm* — Cooper Legal Group, LLC

(57) ABSTRACT

Boot machining device for angular adjustment of a boot sole. The device includes a support frame, a substantially flat board, or flat frame, connected to the support frame and provided with an opening larger than the sole of the boot in order to provide access, securing arrangement fixed in the support frame for securing the boot in the device such that it is accessible from the top side, arrangement for adjusting and locking the angular position of the boot sole around a transverse axis of rotation, and a machining tool carrier for supporting a machining tool, said tool carrier is slidably arranged on the substantially flat board, or flat frame. The sole of the ski boot, after adjustment of the desired angle in transverse and/or longitudinal direction is machined to be substantially parallel by moving the tool carrier in the plane of the substantially flat board, or flat frame.

9 Claims, 4 Drawing Sheets

BOOT MACHINE-DEVICE

TECHNICAL FIELD OF THE INVENTION

The present invention relates to a boot machining device for angular adjustment of a boot sole.

BACKGROUND OF THE INVENTION

Alpine skiing is performed by many peoples around the world. The alpine skier wears a pair of ski boots secured to a pair of skis by fastening devices. There are many different models of boots, skis and fastening devices available on the market to fit different skiers' physical differences and needs.

In order to optimize the performance of the skier it is essential that the boot, the skies and the fastening devices fit together properly, and that the equipment are adjusted to fit the physical properties of the skier.

One feature of adjustment is the angle between the vertical axis of the ski boot, which correspond to vertical axis of the lower part of the leg of the skier, and the longitudinal and transverse axes of the ski. These angles are adjusted by grinding the flat sole of the boot that are aligned with the top surface of the ski to have a flat surface with the desired angle. Initially, before any grinding is done, the surface is substantially transverse to the vertical axis of the boot and after the grinding the surface is angled up to about 10° in relation to the non-grinded surface.

Up to now, these adjustments of the ski boots have been made the trial and error approach in a ski shop, by hand, using a conventional grinding machine. This way of angle adjustment is however inaccurate, and makes the adjustments, that in many cases are done in several steps, time consuming and complicated.

There is consequently a need for a flexible boot machining device that improves the accuracy of the angular adjustments, is more flexible and reduces the time for these adjustment procedures.

SUMMARY OF THE INVENTION

The present invention, defined in independent claims 1 and 10, provides a boot machining device for angular adjustment of a boot sole that fulfils the needs described above, and a method for use of the device.

The boot machining device for angular adjustment of a boot sole comprises:

a support frame, a substantially flat board, or flat frame, connected to the support frame and provided with an opening larger than the sole of the boot in order to provide access to the bottom of the sole from the top side of the flat board, or flat frame;

securing means fixed in the support frame and intended for securing the boot in the device with the boot sole positioned in such a way that it is accessible from the top side of the board, or flat frame, via the opening in the substantially flat board, or flat frame;

means for adjusting and locking the angular position of the boot sole around a transverse axis of rotation in relation to the substantially flat board, or flat frame, and/or means for adjusting the angular position of the boot sole around a longitudinal axis of rotation in relation to the substantially flat board, or flat frame; and a machining tool carrier intended for supporting a machining tool, said tool carrier is slidably arranged on the substantially flat board, or flat frame, to be movable in the plane of the surface of the board, or flat frame;

wherein the sole of the ski boot, after adjustment of the desired angles in transverse and/or longitudinal direction between the sole of the ski boot and the substantially flat board, or flat frame, is machined to be substantially parallel to the flat board, or flat frame, by moving the tool carrier in the plane of the substantially flat board, or flat frame.

The boot machining device according to the present invention provides a flexible and reliably device that makes it possible to do angular adjustments around one or two rotational axes. Furthermore the device makes it possible to use a portable hand held machining tool since the supporting frame in combination with the fastening means ensures that the ski boot is kept properly in the desired position while the substantially flat board in combination with the machining tool carrier provide guidance for the machining tool so that the sole could be easily machined to be parallel to the board.

The boot machining device according to the present invention makes it possible to do angular adjustments with high accuracy with a conventional hand held machining tool. As a result, the device could be made considerably small which makes it possible to bring the device to, for example, the ski slope where the ski boots are tested in combination with the skis, and further corrections and adjustments could be made in an efficient way.

In one embodiment of the invention, the securing means for the boot comprises two jaws shaped to fit the toe and heel portion of the boot. At least one jaw is movable in the longitudinal direction of the intended position of the boot by rotation of a treaded shaft that is passing through a threaded portion in the support frame, said shaft is in one end turnably fastened to the jaw, and in the opposite end provided with a lever, or knob, to facilitate turning of the shaft. The shape of the jaws ensures that the jaws grip, and maintain, the boot in the intended position. Furthermore the movable jaw, or jaws, makes it possible to secure and release the boot in the device in an easy and reliably way.

In one embodiment of the invention, the means for adjusting and locking the angular position of the boot sole around a transverse axis of rotation comprises adjustment devices placed in each longitudinal end of the flat board, or flat frame, that is turnable around an axis of rotation placed close to the longitudinal centre of the board, or flat frame, each adjustment device comprising a rod extending in transverse direction of the intended position of the boot parallel to the transverse axis, said rod is slidably arranged in a vertical slot in a section perpendicular to, and secured in, the substantially flat board, or flat frame, in order to make it possible to adjust the vertical position of each end of the board, or flat frame, and lock the board, or flat frame, in the desired position by clamping means. This embodiment provides a range of adjustment that is defined by the length of the slots. The longitudinal centre of the boot is preferably positioned close to the rotational axis of the board. Furthermore this arrangement is very user friendly since angular adjustments around the transverse axis could be made without removing any components of the device, or repositioning of the boot in relation to the supporting frame.

In one embodiment of the invention, the device comprises an angle adjustment indicator arranged in relation to at least one adjustment device. The indicator facilitates adjustment of the board, and makes it possible to record the exact angular adjustments that have been made for a specific boot. This is a huge benefit since the recorded figures makes it possible to re-create these adjustments on boots for a specific skier later on. The adjustment range around the transverse axis is between −10° to +10°.

In one embodiment of the invention, the means for adjusting the angular position of the boot sole around a longitudinal axis of rotation comprises the two treaded shafts that is used for securing the boot and a second shaft turnably attached to the other jaw, said shafts are positioned coincident with the longitudinal axis of the boot when it is in the intended position so that the boot could be turned around these shafts to the desired angular position where it is locked by a locking device. This embodiment of the invention provides a boot machining device with a simple, and reliable, design without extra components that adds weight, and makes the device more complex.

In one embodiment of the invention, the longitudinal adjustment angle is indicated on at least one longitudinal end of the boot machining device. This embodiment provides an adjustment angle indicator that is visible from the longitudinal ends of the boot machining device. The adjustment range around the longitudinal axis is between −10° to +10°.

Furthermore, in some cases it is possible to use manufacturing marks on the boot as an indicator for the vertical direction of the boot and for calibration of the boot machining device before any angular adjustments of the boot in relation to the flat board is done to increase the accuracy of the adjustments further. If these marks are usable, the calibration procedure is facilitated.

In one embodiment of the invention, the machine tool carrier comprises a substantially flat carrier plate aligning and sliding on the surface of the substantially flat board, or flat frame, guiding devices used to maintain the carrier plate in contact with the board, or flat frame, and fastening means for fastening the machining tool to the machine tool carrier. This embodiment of the invention is useful since it ensures that the tool carrier is kept in the intended position sliding on the flat board even though the flat board not is placed horizontally and/or the surrounding conditions, when the boot machining device is used for example in the ski slop, are difficult. This embodiment of the invention improves the accuracy of the machining of the sole considerably.

In one embodiment of the invention, the machine tool carrier further comprises two parallel rods extending in the transverse direction of the intended position of the boot, said rods are passing through holes in the fastening means in order to provide guidance for the fastening means in the transverse direction. This embodiment of the invention improves the accuracy of the machining of the sole considerably.

The machining tool either is a hand held powered tool such as a grinding machine, a router machine or a cutting machine, or a stationary powered rotating machine tool mounted on the machining tool carrier. One of the major advantages with the present invention is that it could be used in combination with a conventional portable hand held tool, preferably a plunge router, a cutting machine, or a stationary mounted machining tool. If desired, the machining tool could be released from the boot cutting device during transportation of the boot machining device, and if the machining tool breaks, the boot machining device could be used with another machining device.

The present invention furthermore relates to a method for angular adjustment of a sole of a ski boot by use of a boot machining device according to claim 1. The method comprises the steps:

a) securing the boot in a support frame;

b) calibrate the sole of the ski boot to be substantially parallel to a substantially flat board, or flat frame, of the device;

c) adjust the angular position of the boot sole around a transverse axis of rotation in relation to the substantially flat board, or flat frame, and/or adjust the angular position of the boot sole around a longitudinal axis of rotation in relation to the substantially flat board, or flat frame; and d) secure the boot in relation to the support frame when the desired angular positions are achieved;

e) machine the sole by moving a machining tool in the plane of the substantially flat board, or flat frame, until the entire sole is machined and substantially parallel to the substantially flat board, or flat frame;

The use of this method for angular adjustments of the sole of a ski boot ensures that the desired adjustment angles could be performed with the required accuracy, and recorded for re-creation later on.

Further advantages and details of the invention will be recognised in the detailed description.

BRIEF DESCRIPTION OF THE DRAWINGS

One embodiment of the present invention is illustrated in the appended drawings, in which.

DETAILED DESCRIPTION

Figure 1:
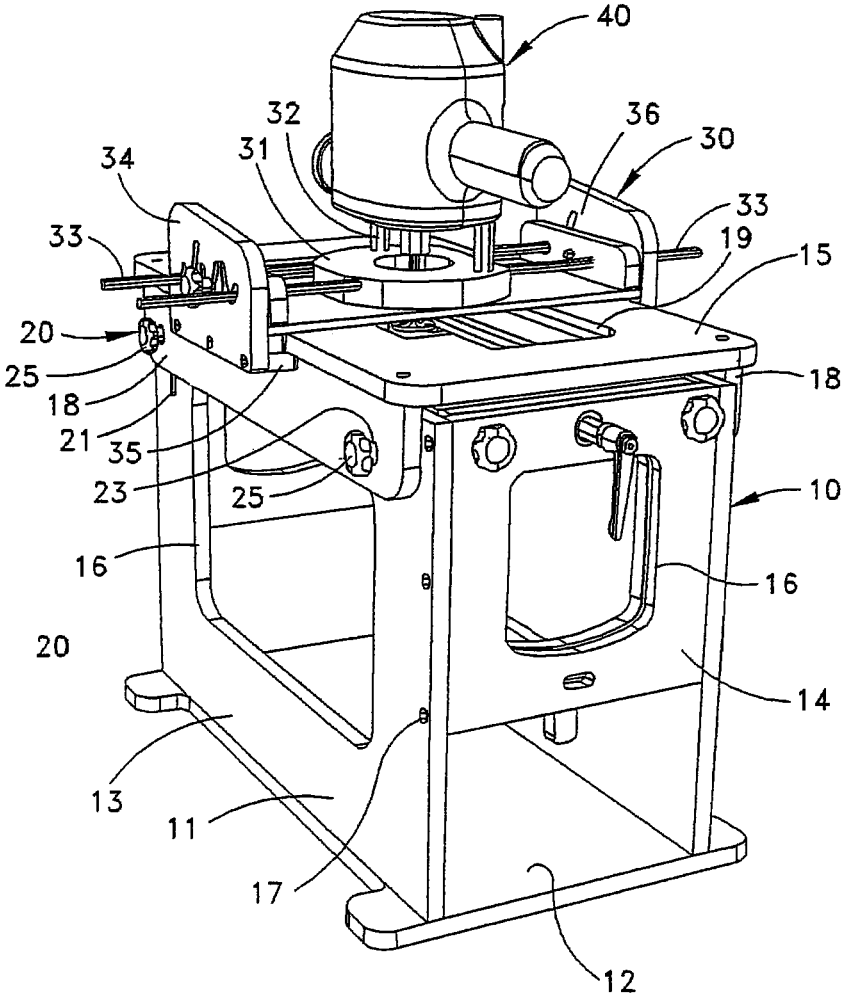
FIG. 1 illustrates a perspective view of the boot machining device and a machining tool.
Figure 2:
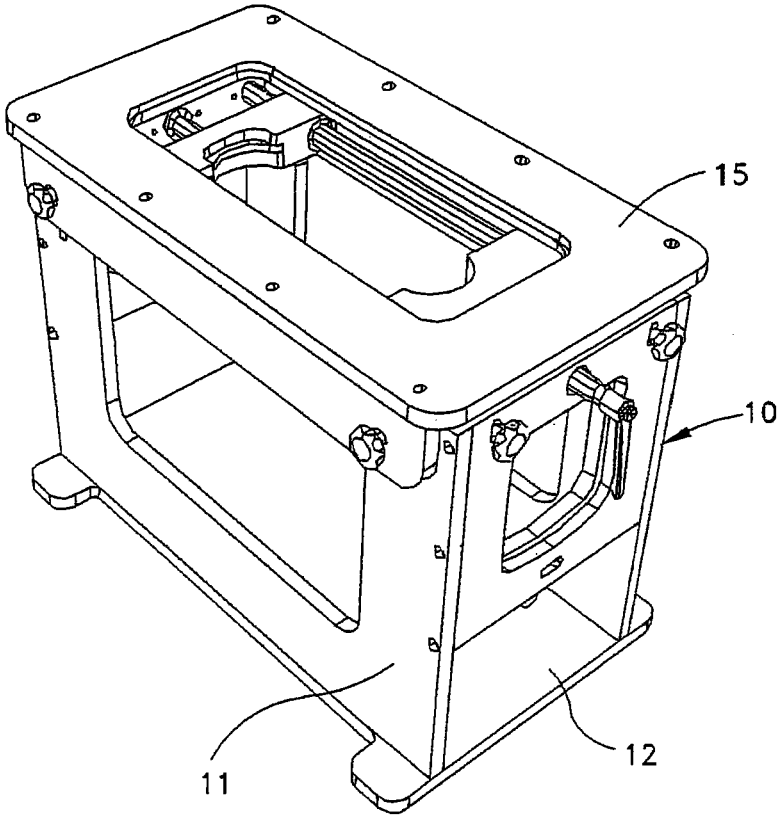
FIG. 2 illustrates a perspective view of the boot machining device without the machine tool carrier and machining tool.

In FIG. 1, a first embodiment of a boot machining device 10 according to the present invention is illustrated. The boot machining device 10 comprises a supporting frame 11 shaped as a box with a rectangular bottom 12, two longitudinal side walls 13, two end walls 14 and a substantially flat board 15 movably arranged on the top side of the supporting frame 11. All side walls 13 and 14 have centrally positioned openings 16 in order to facilitate the positioning of a ski boot within the supporting frame 11, make it possible to visually see that the ski boot is correctly positioned in the device 10 and to reduce the overall weight of the boot machining device 10. The bottom 12, side walls 13 and end walls 14 are put together by a number of screws 17 to form the rigid support frame 11.

The flat board 15 is rectangular and provided with an opening 19 of at least the same size as the size of the boot sole of a ski boot for an adult. The flat board 15 is slightly wider than the box shaped support frame 11 and extend a distance outside the support frame 11. Along the longitudinal sides of the flat board 15 an elongated section 18 extend perpendicularly from the bottom side of the flat board 15 outside the longitudinal side walls 13 of the support frame 11. In order to make it possible to adjust the angular position of the flat board 15 in relation to the support frame 11, each longitudinal end of the flat board 15 is provided with means for adjusting the angular position of the flat board 15 that is turnable around a transverse axis of rotation placed in the longitudinal centre of the elongated section 18, which means that if one end of the flat board 15 is moved upwards, the opposite end of the board 15 is moved a similar distance downwards.

In the illustrated embodiment of the device 10 the means for adjustment of the angular position of the board 15 consist of an adjustment device 20 placed in relation to each corner of the flat board 15. Each adjustment device 20 comprises a slot 23 shaped like a circular arc and positioned at constant radial direction from the axis of rotation placed in the longitudinal centre of the elongated section 18. The slot 23 is arranged in the elongated section 18 close the longitudinal end of the elongated section 18 in the area where the side wall 13 and the elongated section 18 overlap each other. Each adjustment device furthermore comprises a knob 25 with a treaded rod, not visible in the figures, extending in substantially transverse direction of the intended position of the boot parallel to the transverse axis of rotation through the slot 23 and a threaded hole in the upper corner of the side wall 13. Thereby the rod 22 is able to slide in the slot 23. The length of the slots 23 defines the adjustment range for the flat board 15 around the transverse axis. An angle indicator 21 is provided in relation to at least one adjustment device 20. The adjustment device 20 is locked in the selected position by turning the knob 25 thereby locking the flat board 15 and the elongated section 18 in relation to the side wall 13 of the supporting frame 11.

On top of the flat board 15 a machining tool carrier 30 intended for supporting a machining tool 40 is slidably arranged on the substantially flat board 15 to be movable in the plane of the board 15. The carrier comprises a sliding plate 45 aligning the surface of the board 15, and a machine sole 31 arranged above the sliding plate 45. From the machine sole 31 two vertically adjustable supporting rods 32 extend upwards. These supporting rods 32 could be a part of the machining tool 40, or the tool carrier 30, and are used for adjusting the vertical position of the cutting tool used for the machining of the boot sole.

In order to ensure the desired accuracy of the machined boot sole the machine tool carrier 30 must be kept in the desired position, in direct contact with the surface of the board 15. This is achieved by gripping means arranged to grip the longitudinal edges of the flat board 15. The gripping means comprises two rods 33 extending parallel to the transverse axis of rotation and having a length longer than the width of the flat board 15. The rods 33 extend through holes, or grooves, in the machine sole 31, and in each end through a rod spacer 36 and a tool carrier side plate 34. The position and space between the transversal rods 22 are specific for the machining tool used in combination with the tool carrier 30. The side plates 34 are provided with a protruding flange 35 that grip the edge along the longitudinal sides of the flat board 15 to ensure that the tool carrier 30 is held in contact with the surface of the board 15. The rods 33, that in this embodiment are secured in the machine sole 31, slides smoothly through the side plates 34 and the rod spacer 36 arranged in relation to each side plate 34 in order to provide guidance in transversal movements of the machine sole 31. The side plates provide guidance during longitudinal movements of the tool carrier 30. Preferably the surfaces of the tool carrier sliding plate 45 in contact with the flat board 15 and machine sole 31 are smooth to reduce the friction between the surfaces to provide a steady longitudinal and transversal movement of the machining device 40.

Figure 3:
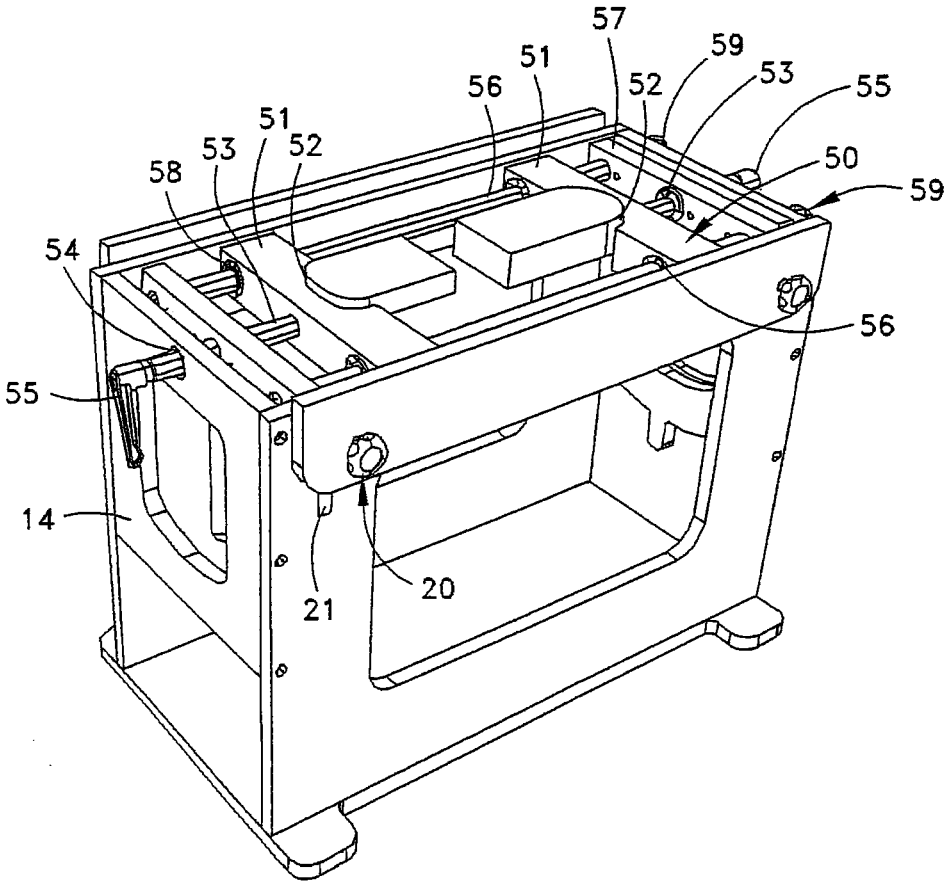
FIG. 3 illustrates the device and a ski boot sole secured in the intended position but without the flat board.

In FIG. 3 the flat board 15 is removed to more clearly illustrate the interior of the device 10 where securing means 50 are arranged close to the top of the box shaped supporting frame 11 to secure the ski boot in the device 10. The securing means 50 comprises two jaws 51 provided with recesses 52 shaped to grip the toe and heel portions of a ski boot and two treaded shafts 53 extending in opposite longitudinal directions coinciding with the longitudinal axis of rotation for the device 10 from respective jaw 51 and through a treaded passage 54 in respective longitudinal end wall 14 so that the jaws 51 are moved in longitudinal direction towards and away from each other by rotation of the treaded shafts 53. The ends of the shafts 53 opposite the jaws 51 are provided with a lever 55 to facilitate turning of the shafts 53. Each jaw 51 has a width smaller than the interior width of the support frame 11. The securing means 50 furthermore comprises two guiding rods 56 extending in parallel direction to the longitudinal axis of rotation from a first support device 57 through holes 58 in respective jaw 51 to a second support device 57 before they exits the supporting frame 11 via guiding slots, not visible in the figures, in one of the longitudinal end walls 14 of the supporting frame 11. Thereby the entire securing means 50, and ski boot secured between the jaws 51, are turnable around the two treaded shafts 53, i.e. turnable around the longitudinal axis of the ski boot. The two ends of the guiding rods 56 that extend through the guiding slots in the side wall 14 are treaded and provided with locking knobs 59 that are used for locking the securing means in the desired angle in relation to the flat board by rotating the knob 59. The angular adjustment angle is indicated on at least one of the longitudinal end walls 14 to facilitate adjustments and recording of the adjustments. The angular settings can be read out as fractions of degrees or millimeters on the side of the sole.

Once the angular adjustments have been completed, the bottom of the sole is machined to the parallel to the flat board 15. The machining tool 40 illustrated in the drawings is a hand held electrically, or air powered, cutting machine or plunge router. Alternatively a stationary, rotating device could be arranged on the tool carrier. The machining of the boot sole is done by a cutting tool 41 placed in the end of a shaft 42. The cutting machine 40 is secured in the machining tool carrier 30 with the shaft 42 extending in the substantially perpendicular direction upwards from the substantially flat board 15. The distance between the boot sole is adapted to fit with the length of the shaft 42 so that the shaft extend through the opening 19 in the flat board 15 and further down to the boot sole. During use, the cutting tool 41 is rotated at high speed and the cutting machine 40 moved within the plane of the flat board 15 in order to cut piece by piece of the sole until the sole is completely parallel to the board 15.

In the toe and heel portion of a ski boot a protruding shoulder extend in forward and backward direction. These protruding shoulders are used in order to make it possible for the fastening devices on the skis to grip the ski boot in a reliably manner. When the bottom of the boot sole has been machined during angular adjustments around the longitudinal axis, the right and left side of these protruding shoulders will have different heights. These differences will have a negative impact on the fastening of the ski boot to the ski and preferably the top side of these protruding shoulders is machined to uniform thickness.

Figure 4:
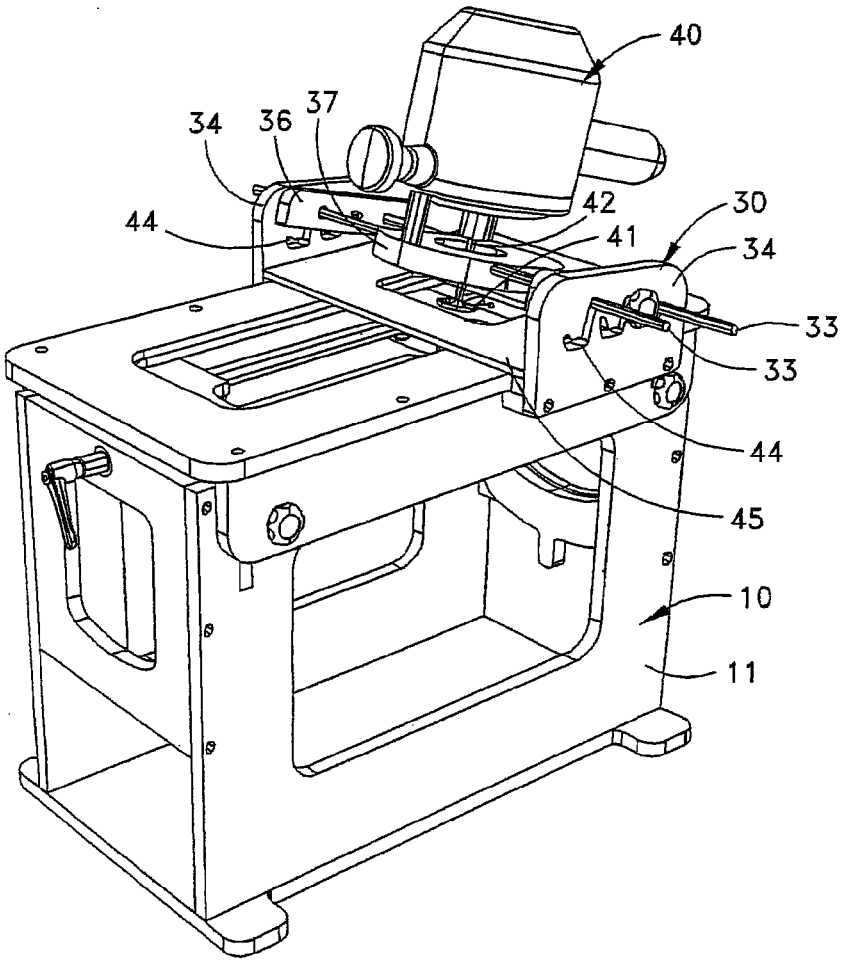
FIG. 4 illustrates the machining tool carrier and the machining tool in one of the angled positions.

The fastening devices are designed for ski boot soles with a wedge shaped cut away portion in the toe and heel portion of the sole bottom. During the angular adjustments of the sole, these cut away portions will be partly, or completely, eliminated. The guiding rods 33 for the machining tool carrier 30 that extends in the transverse direction of the device 10 are therefore led through the side plates 34 via grooves 44 with a shape that makes it possible to reposition the tool carrier 30 from its normal position aligning the flat board 15 to two positions where the tool carrier 30 is angled in relation to the board 15, illustrated in FIG. 4. One of these positions are used for cutting a new wedge shaped cut away portion in the toe, while the second position is used for forming the cut away portion in the heel of the ski boot. The side plates 34 are furthermore provided with a clamping device comprising a treaded shaft, a nut and a knob 45 placed close to the centre of the plate 34 in order to make it possible to secure the tool carrier 30 in the selected angular position. Also when tool carrier 30 is the two angled positions, the tool carrier 30 is movable along the transversely directed guiding rods 33 to be able to machine the complete width of the sole.

While one presently preferred embodiment of the invention has been described herein, it is to be understood that the invention is not so limited but covers and includes any and all modifications and variations that are encompassed by the following claims.

What is claimed is:

1. Boot machining device for angular adjustment of a boot having a sole, said device comprising:

a support frame, a substantially flat board, or flat frame, connected to the support frame and provided with an opening larger than the sole of the boot in order to provide access to the bottom of the sole from the top side of the board, or flat frame;

securing means fixed in the support frame and intended for securing the boot in the device with the boot sole positioned in such a way that it is accessible from the top side of the board, or frame, via the opening in the substantially flat board, or flat frame;

means for adjusting and locking the angular position of the boot sole around a transverse axis of rotation in relation to the substantially flat board, or flat frame, and/or means for adjusting the angular position of the boot sole around a longitudinal axis of rotation in relation to the substantially flat board, or flat frame; and a machining tool carrier intended for supporting a machining tool, said tool carrier is slidably arranged on the substantially flat board, or flat frame, to be movable in the plane of the board, or flat frame;

wherein the sole of the boot, after adjustment of the desired angle in transverse and/or longitudinal direction between the sole of the boot and the substantially flat board, or flat frame, is machined to be substantially parallel to the flat board, or flat frame, by moving the tool carrier in the plane of the substantially flat board, or flat frame and wherein the machining tool carrier comprises a substantially flat sliding plate aligning and sliding on the surface of the board, or flat frame, a machine sole and guiding devices used to maintain the sliding plate in contact with the board and fastening means for fastening the machining tool to the machine tool carrier.

2. Boot machining device according to claim 1, wherein the securing means for the boot comprises two jaws shaped to fit the toe and heel portion of the boot, at least one jaw is movable in the longitudinal direction of the intended position of the boot by rotation of a threaded shaft passing through a threaded portion in the support frame, said shaft is in one end turnably fastened to the jaw and in the opposite end provided with a lever, or knob, to facilitate turning of the shaft.

3. Boot machining device according to claim 2, wherein the means for adjusting and locking the angular position of the boot sole around a transverse axis of rotation comprises adjustment devices placed in each longitudinal end of the flat board, or flat frame, that are turnable around an axis of rotation placed close to the longitudinal centre of the board, or flat frame, each adjustment device comprising a rod extending in transverse direction of the intended position of the boot parallel to the transverse axis, said rod is slidably arranged in a vertical slot in a section perpendicular to, and secured in, the substantially flat board, or flat frame, in order to make it possible to adjust the vertical position of each end of the board, or flat frame, and lock the board, or flat frame, in the desired position by clamping means.

4. Boot machining device according to claim 3, wherein an angle adjustment indicator is arranged in relation to at least one adjustment device.

5. Boot machining device according to claim 2, wherein the means for adjusting the angular position of the boot sole around a longitudinal axis of rotation comprises the at least one threaded shaft that is used for securing the boot and a second shaft turnably attached to the other jaw, said shafts are positioned coinciding with the longitudinal axis of the boot when it is in the intended position so that the boot could be turned around these shafts to the desired angular position where it is locked by a locking device.

6. Boot machining device according to claim 5, wherein the adjustment angle is indicated on at least one longitudinal end wall of the boot machining device.

7. Boot machining device according to claim 1, wherein the machine tool carrier further comprises two parallel rods extending in the transverse direction of the intended position of the boot, said rods are passing through holes in the fastening means in order to provide guidance for the fastening means in the transverse direction.

8. Boot machining device according to claim 1, wherein the machining tool either is a hand held powered tool such as a grinding machine, a router machine or a cutting machine, or a stationary powered rotating machine tool mounted on the machining tool carrier.

9. Method for angular adjustment of a sole of a ski boot by use of a device according to claim 1, said method comprising the steps:

a) securing the boot in the support frame;

b) calibrate the sole of the ski boot to be substantially parallel to the substantially flat board, or flat frame, of the device;

c) adjust the angular position of the boot sole around a transverse axis of rotation in relation to the substantially flat board, or flat frame, and/or adjust the angular position of the boot sole around a longitudinal axis of rotation in relation to the substantially flat board, or flat frame; and d) secure the boot when the desired angular positions are achieved;

e) machine the sole by moving a machining tool in the plane of the substantially flat board, or flat frame, until the entire sole is machined and substantially parallel to the substantially flat board, or flat frame.

* * * * *